US009413051B2

(12) United States Patent
Milroy et al.

(10) Patent No.: US 9,413,051 B2
(45) Date of Patent: Aug. 9, 2016

(54) RADIO FREQUENCY DEVICE WITH FEED STRUCTURE

(71) Applicant: ThinKom Solutions, Inc., Torrance, CA (US)

(72) Inventors: William Milroy, Torrance, CA (US); Alan C. Lemons, San Pedro, CA (US); James Sor, San Pedro, CA (US)

(73) Assignee: ThinKom Soultions, Inc., Hawthorne, CA (US)

( * ) Notice: Subject to any disclaimer, the term of this patent is extended or adjusted under 35 U.S.C. 154(b) by 292 days.

(21) Appl. No.: 14/013,279

(22) Filed: Aug. 29, 2013

(65) Prior Publication Data

US 2015/0061795 A1 Mar. 5, 2015

(51) Int. Cl.

| | |
|---|---|
| ***H01P 5/04*** | (2006.01) |
| ***H01Q 13/02*** | (2006.01) |
| ***H01P 3/02*** | (2006.01) |
| ***H01P 5/103*** | (2006.01) |
| ***H01P 5/12*** | (2006.01) |
| ***H01Q 13/20*** | (2006.01) |
| ***H01Q 21/00*** | (2006.01) |
| ***H01P 3/00*** | (2006.01) |
| *H01P 5/02* | (2006.01) |

(52) U.S. Cl.

CPC *H01P 3/023* (2013.01); *H01P 3/00* (2013.01); *H01P 5/103* (2013.01); *H01P 5/12* (2013.01); *H01Q 13/20* (2013.01); *H01Q 21/0012* (2013.01); *H01Q 21/0031* (2013.01); *H01P 5/024* (2013.01)

(58) Field of Classification Search

CPC ..... H01Q 9/285; H01Q 13/02; H01P 3/023; H01P 3/00; H01P 5/04; H01P 5/08; H01P 5/107; H01P 5/108

USPC ..... 343/772, 786, 793; 333/237, 24 R

See application file for complete search history.

(56) References Cited

U.S. PATENT DOCUMENTS

| | | | | |
|---|---|---|---|---|
| 6,538,603 | B1 | 3/2003 | Chen et al. | |
| 7,916,094 | B2 | 3/2011 | Neto et al. | |
| 8,421,698 | B2 | 4/2013 | Neto et al. | |
| 8,816,914 | B2 * | 8/2014 | Wong | H01Q 1/243 343/700 MS |
| 2012/0329404 | A1 * | 12/2012 | Yang | H01Q 1/243 455/73 |

FOREIGN PATENT DOCUMENTS

| | | |
|---|---|---|
| FR | 2 619 658 | 2/1989 |
| JP | H03 219708 | 9/1991 |
| JP | 2001 284955 | 10/2001 |
| WO | WO 91/17586 | 11/1991 |

OTHER PUBLICATIONS

Extended European Search Report dated Feb. 2, 2015 for corresponding European application No. 14182651.1 filed on Aug. 28, 2014.

* cited by examiner

*Primary Examiner* — Dinh T Le

(74) *Attorney, Agent, or Firm* — Renner, Otto, Boisselle & Sklar, LLP

(57) ABSTRACT

A radio frequency (RF) device includes an RF transmission line structure having opposing boundary walls with a non-rectilinear form factor, and a feed structure configured to introduce RF energy into an area between the opposing boundary walls to illuminate the RF transmission line structure with the RF energy across the non-rectilinear form factor. The feed structure includes a plurality of traveling-waveguide-fed leaky line-segment structures, each configured to launch the RF energy into the area with a propagation direction having an oblique angle relative to an axis of the line-segment structure.

16 Claims, 8 Drawing Sheets

RADIO FREQUENCY DEVICE WITH FEED STRUCTURE

TECHNICAL FIELD

The present invention relates generally to radio frequency (RF) devices employing a feed structure, and more particularly area-efficient feeding of transmission-line structures.

BACKGROUND ART

RF transmission line structures oftentimes include opposing boundary walls between which electromagnetic or RF energy is intended to propagate. Types of RF transmission line structures include open parallel-plate, waveguide and resonant cavity based structures, for example. Frequently the RF transmission line structures are combined with a feed structure configured to introduce RF energy into an area between the opposing boundary walls in order to efficiently and effectively illuminate the RF transmission line structure, tailored to the desired phase and amplitude distribution. Most often, efficient launching or illumination of the RF energy with well-behaved coherency (uniform phase illumination) over a broad operating frequency bandwidth is desired.

Current practice for feeding parallel-plate and waveguide-based planar array type RF transmission line structures include: inscribed square/rectangle feed architecture wherein a line-feed or a linear array of couplers (waveguide- or coax-based feed-points oriented along a single line) launch a coherent internal plane-wave that illuminates a generally rectangular region (but leaves exterior regions outside the inscribed rectangular region, but inside the circular boundary, generally un-illuminated/wasted;) discrete perimeter feed architectures which use individual elements or groups of elements oriented along the array perimeter in order to feed a larger proportion of the circular region, but generally support only narrow operating frequency bands and require complex and difficult to package waveguide feeds and launches/transitions in order to provide the requisite phase coherency; and direct-fed waveguide slot antennas wherein a separate complex (rear-mounted) corporate and/or standing-wave-fed waveguide feed is employed to coherently illuminate the desired circular antenna shape in a "scalloped" pseudo-circular form-factor.

Notably, in open parallel-plate planar array antenna applications, for example, it is often desired to shape the antenna in a circular or near-circular (elliptical) shape. Examples include planar array surrogates for circular or elliptical parabolic dish antennas (for satellite communication, terrestrial point-to-point communication, radar systems, etc.) However, traditional waveguide-based feed architectures, by their nature, are generally rectilinear in nature and are therefore challenged to efficiently feed a circular shape. An inscribed-square geometrically fills only 64% of a circular area and due to finite limitations, it is generally not possible to feed the antenna all the way to its physical perimeter (i.e. "practical" inscribed-square efficiencies are typically less than 60%.)

Generically, the planar array antennas in circular or elliptical form-factors are generally fed via a separate rear-mount (direct-fed waveguide slot antennas) wherein a separate complex (rear-mounted) corporate and/or standing-wave-fed waveguide feed is employed to coherently illuminate the desired circular antenna shape in a "scalloped" pseudo-circular form-factor. Such arrays are inherently limited to narrow frequency-band operation and the bulk and packaging complexity associated with the (typically-multi-level) waveguide corporate feed adds undesired weight and cost.

In the special case of parallel-plate transmission-line based planar array antennas such as the Continuous Transverse Stub (CTS) array and Variable Inclination Continuous Transverse Stub (VICTS) array, current state of the (feed) technology has been traditionally to utilize (in ascending order of increased area efficiency and increased cost/complexity) a single linear-feed ("inscribed square/rectangle";) or multiple parallel linear-feeds ("stepped feed";) or multiple subarrays ("modularized feed";) or via discretely-fed perimeter feed slots ("perimeter slot feed".) While these approaches have varying levels of area-efficiency effectiveness, all suffer from the common inability to completely fill the entire circular extent of the antenna array and (particularly in the case of the latter more complex structures) significantly increase complexity and cost while limiting overall operating frequency bandwidth.

FIG. 1 illustrates a typical "inscribed square" feed methodology wherein a single waveguide line-feed 10 represents a linear RF source which coherently launches propagating parallel-plate electromagnetic waves 12 within a bounded parallel-plate region 14 and generally emanating at an angle normal/orthogonal to an axis 16 of the feed 10. The parallel-plate region 14 has a circular form factor, and the line-feed 10 illuminates a square-shaped or rectangular-shaped region 20 inscribed within the available circular region. Geometrically, this approach excites 64% of the available area, but in practice this figure is generally lower due to practical limitations on the physical extent of the line-feed 10.

FIG. 2 illustrates a variant of the inscribed square of FIG. 1, wherein multiple rectangular regions of propagating parallel-plate waves 12 are created, each fed by its own dedicated single waveguide line-feed 10. This method can provide marginally higher area efficiencies as compared to the inscribed-square, but at the expense of significantly higher component count and overall packaging complexity. In addition the foreshortened length of the wave/mode paths within each rectangular region can result in unintended consequences, for example constraints on antenna radiator coupling as well as undesired antenna sidelobe artifacts associated with the imperfect "blending" (discontinuities) between adjacent regions in the case of a planar array antenna.

A further extension of the rectangular approach (not shown) is known, wherein the feed is "modularized" into individual subarray regions with their own corresponding feeds. Such extension has the benefit of added area efficiency (filling of the available circular form factor) but again at the expense, for example, of antenna radiator coupling and sidelobe degradation in the case of a planar array antenna.

FIG. 3 illustrates a "Perimeter Discrete" feed method wherein individual feed elements 22 are introduced along the perimeter (in this case the left half) of the circular form factor of the parallel-plate region 14. The individual feed elements 22 launch the propagating parallel-plate waves 12 across the left half, and (as an option) a waveguide line-feed 10 located in the middle of the circular form factor launches the parallel-plate waves 12 across the right half. Again, this method realizes good improvement in area efficiency (fill-factor), but with substantial added feed network complexity for the individual feed elements 22. In the case of a planar array antenna type RF transmission line structure, again there is associated antenna sidelobe degradation.

In view of the above-noted shortcomings, there is a strong need in the art for an RF device which includes a more efficient feed arrangement for illuminating an RF transmission line structure in the case of a non-rectilinear form factor.

SUMMARY

According to an aspect, a radio frequency (RF) device is provided which includes an RF transmission line structure including opposing boundary walls with a non-rectilinear form factor; and a feed structure configured to introduce RF energy into an area between the opposing boundary walls to illuminate the RF transmission line structure with the RF energy across the non-rectilinear form factor. The feed structure includes a plurality of traveling-waveguide-fed leaky line-segment structures, each configured to launch the RF energy into the area with a propagation direction having an oblique angle relative to an axis of the line-segment structure.

According to another aspect, the plurality of leaky line-segment structures are positioned proximate a perimeter of the non-rectilinear form factor.

In accordance with another aspect, the non-rectilinear form factor is circular or elliptical.

According to yet another aspect, the plurality of leaky line-segment structures are positioned along corresponding chords of the circular or elliptical form factor.

According to still another aspect, two or more of the plurality of leaky line-segment structures are oriented at oblique angles to one another.

In yet another aspect, two of the plurality of leaky line-segment structures are oriented at an oblique angle to one another and extend from a common vertex.

According to another aspect, two of the plurality of leaky line-segment structures are oriented at an oblique angle to one another and the feed structure further includes one or more feed segments which separate the two plurality of leaky line-segment structures and are configured to launch the RF energy into the area with a propagation direction having a non-oblique angle relative to an axis of the feed segment.

In accordance with another aspect, one or more of the plurality of leaky line-segment structures is an end-fire leaky waveguide.

In still another aspect, the end-fire leaky waveguide includes at least one of a continuous broadwall coupling slot, an array of discrete broadwall slots or apertures, or an array of discrete sidewall slots or apertures.

Regarding another aspect, the end-fire leaky waveguide includes a meandering slot.

In yet another aspect, the end-fire leaky waveguide has a variation in the "a" (broadwall) dimension along a length of the end-fire leaky waveguide.

According to another aspect, the plurality of leaky line-segment structures are positioned at least one of between the opposing boundary walls, adjacent an outer surface of one or both of the opposing boundary walls, or adjacent an opening between the opposing boundary walls along a perimeter of the non-rectilinear form factor.

According to still another aspect, the RF transmission line structure comprises at least one of a parallel-plate transmission structure, a partially open transmission structure having a lower-plate covered in a dielectric layer, a waveguide, or a resonant cavity.

In still another aspect, the plurality of leaky line-segment structures are configured to launch the RF energy in coherent waves.

According to another aspect, at least one of the plurality of leaky line-segment structures comprises a curved waveguide including at least one of a linear continuous broadwall coupling slot, a linear array of discrete broadwall slots or apertures, or a linear array of discrete sidewall slots or apertures.

In yet another aspect, the curved waveguide has a constant "a" (broadwall) dimension.

In accordance with another aspect, a leaky line-segment structure is provided which includes a curved waveguide, and formed in the curved waveguide at least one of a linear continuous broadwall coupling slot, a linear array of discrete broadwall slots or apertures, or a linear array of discrete sidewall slots or apertures.

According to another aspect, the at least one of the linear continuous broadwall coupling slot, the linear array of discrete broadwall slots or apertures, or the linear array of discrete sidewall slots or apertures is formed in a flat wall of the curved waveguide.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION

Provided is an RF device having a more efficient feed arrangement for illuminating an RF transmission line structure with a non-rectilinear form factor. The device departs from the traditional use of one or more rectilinear line-segment structures emanating RF energy at an angle normal/orthogonal to an axis of the line-segment structure. Instead, the device employs multiple line-segment structures which emanate RF energy at an angle which is oblique relative to the axis of the line-segment structure. The multiple line-segment structures may be obliquely angled relative to one another in order to more efficiently inscribe and feed/illuminate the desired non-rectilinear form factor in a piece-wise linear manner. The line-segment structures are traveling-waveguide-fed leaky line-segment structures, each configured to launch the RF energy with a propagation direction having an oblique angle relative to an axis of the line-segment structure. These replace generally more complex conventional multi-level feed architectures with a resultant benefit in size, weight, complexity, and cost. Moreover, the traveling-waveguide-fed leaky line-segment structures can exhibit unusual beneficial properties in terms of improved operating frequency bandwidth as compared to conventional feeding techniques.

Figure 1:
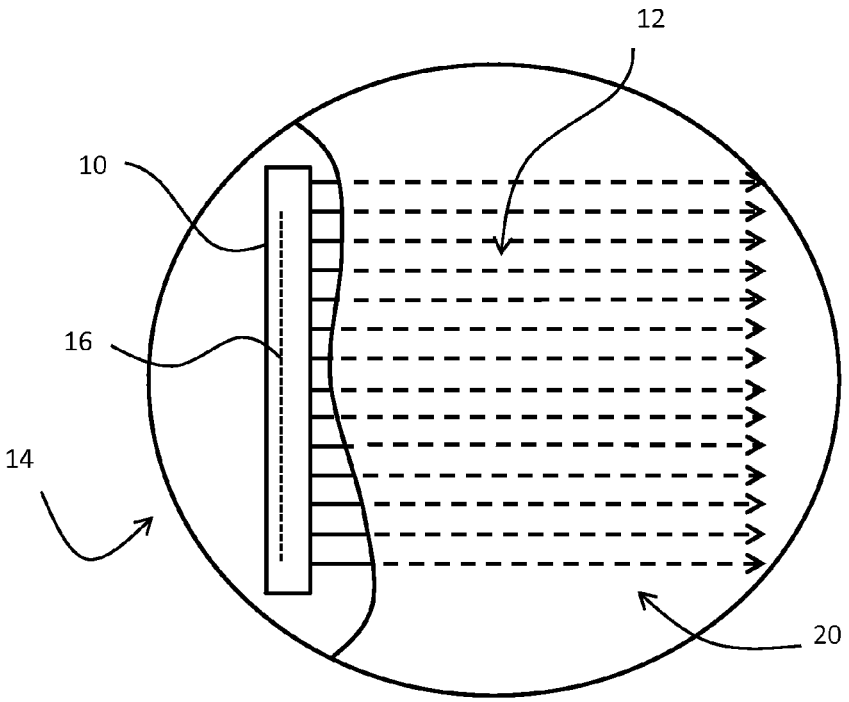
FIG. 1 CONVENTIONAL ART
FIG. 1 is a schematic illustration in partial cutaway of a first example of a conventional RF device having a feed structure.
Figure 2:
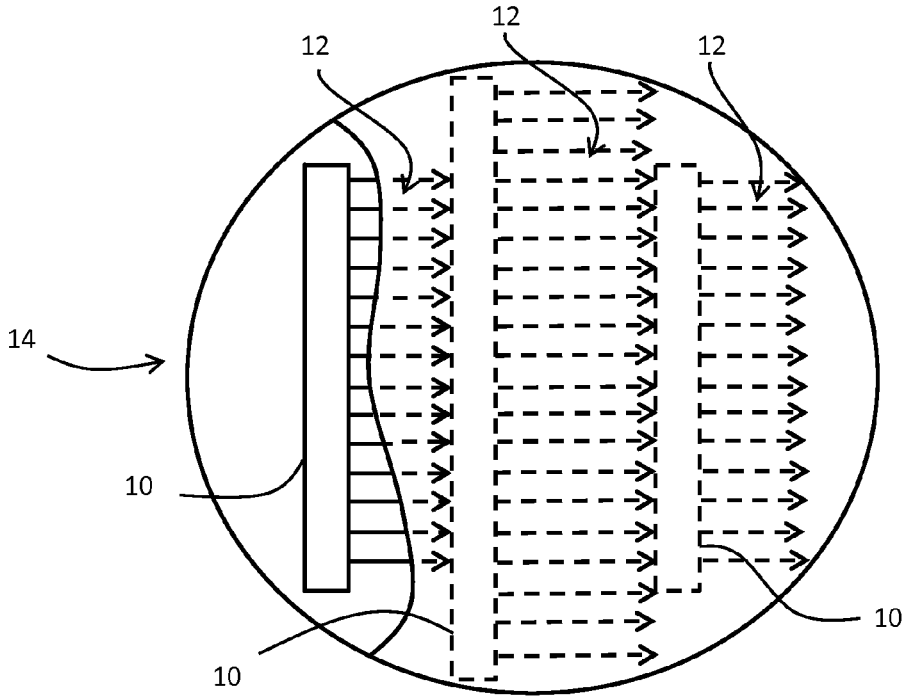
FIG. 2 CONVENTIONAL ART
FIG. 2 is a schematic illustration in partial cutaway of a second example of a conventional RF device having a feed structure.
Figure 3:
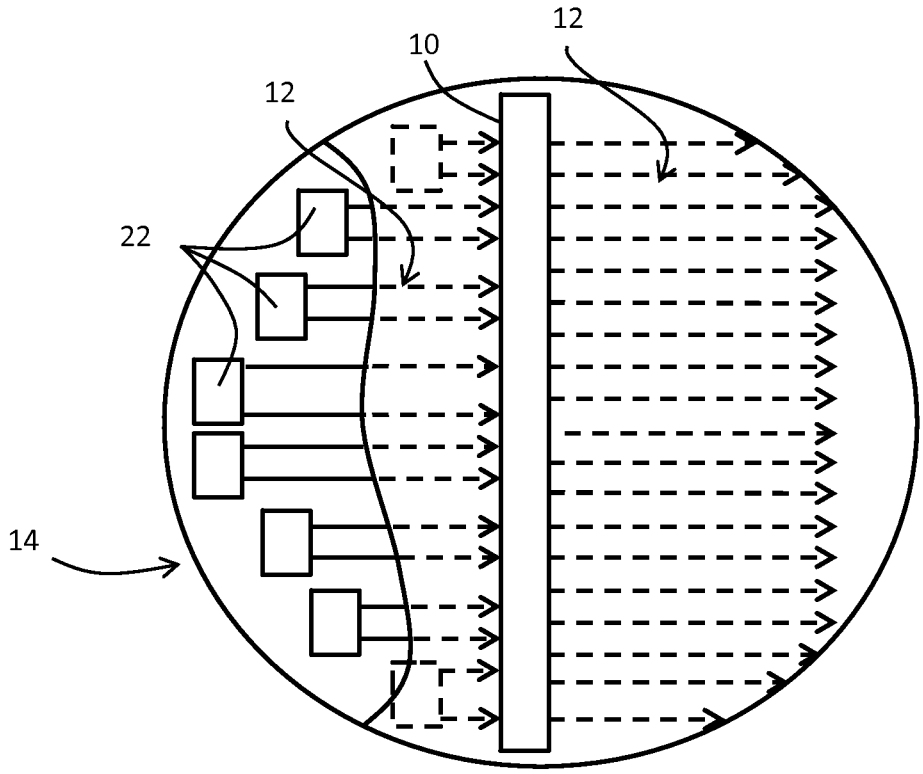
FIG. 3 CONVENTIONAL ART
FIG. 3 is a schematic illustration in partial cutaway of a third example of a conventional RF device having a feed structure.
Figure 4A:
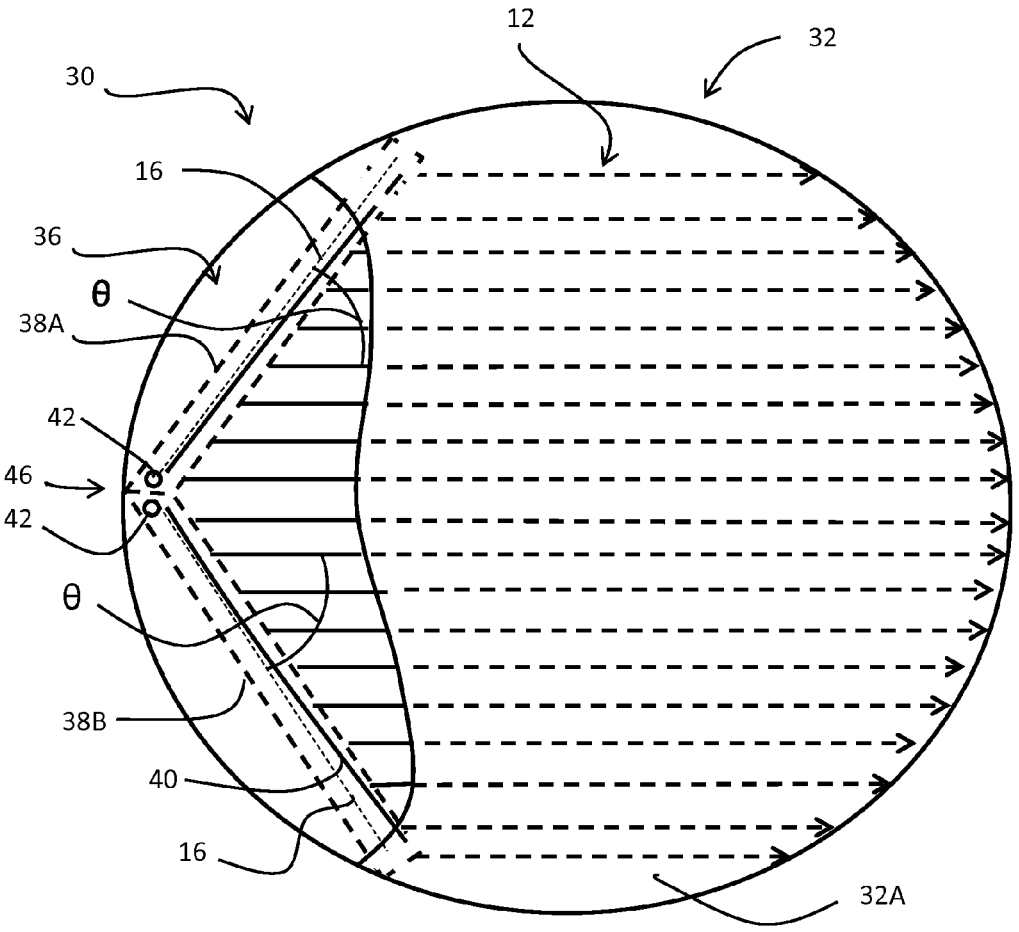
FIG. 4A is a top-view schematic illustration in partial cutaway of a first exemplary embodiment of an RF device having a feed structure arrangement in accordance with the present invention.
Figure 4B:
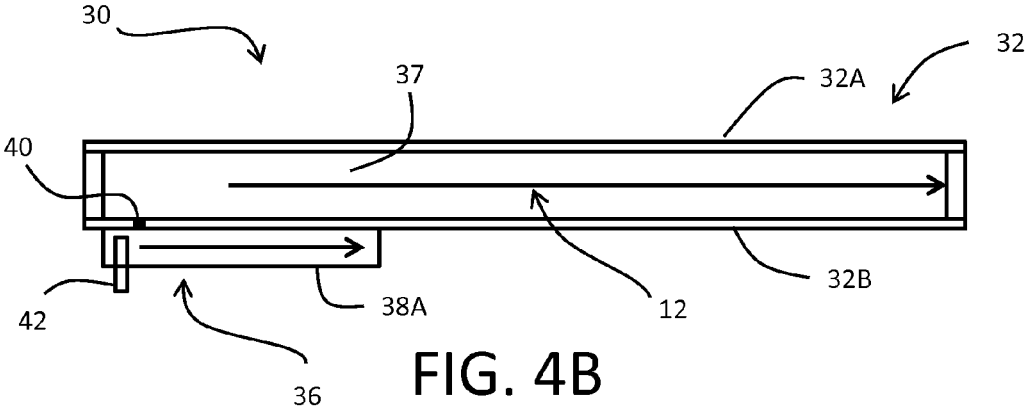
FIG. 4B is a schematic cross-sectional illustration of the RF device shown in FIG. 4A.
Figure 4C:
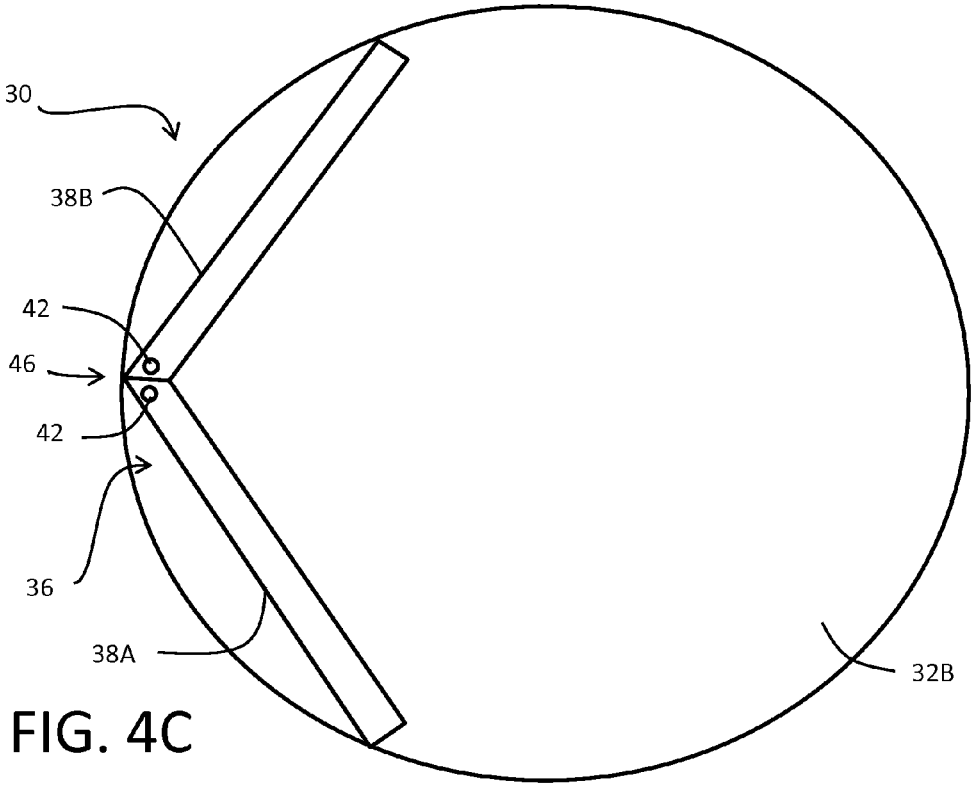
FIG. 4C is bottom-view schematic illustration of the RF device shown in FIG. 4A.

Referring to FIGS. 4A-4C, shown is an RF device 30 in accordance with a first embodiment. The RF device 30 includes an RF transmission line structure 32 including opposing boundary walls 32A, 32B. The RF transmission line structure 32 has a non-rectilinear form factor, in this particular embodiment circular although other non-rectilinear form factors are equally possible (e.g., elliptical, non-rectilinear polygonal, etc.). In this embodiment the RF transmission line structure is an open parallel-plate transmission structure including boundary walls 32A, 32B made up of parallel conductive plates within which can propagate parallel-plate RF waves and modes. According to an alternative embodiment, the RF transmission line structure 32 can instead be any other transmission structure having opposing boundary walls through which can propagate RF waves and modes. For example, the RF transmission line structure 32 may be a partially open transmission structure having a lower-plate covered in a dielectric layer, a waveguide, resonant cavity, etc., (each having opposing boundary walls) without limiting the scope of the RF device 30 described herein.

The RF transmission line structure 32 may include, but is not limited to, homogeneously or inhomogeneously filled parallel-plates representing boundary walls 32A, 32B. The parallel-plates may or may not be strictly parallel but are suitably parallel to enable suitable transmission of parallel plate waves. One or both of the parallel plates representing the boundary walls 32A, 32B may include corrugated conductors on the surface thereof.

The RF device 30 further includes a feed structure 36 configured to introduce RF energy into an area 37 between the opposing boundary walls 32A, 32B to illuminate the RF transmission line structure 32 with the RF energy across the non-rectilinear form factor. Most preferably, the feed structure 36 is configured to illuminate the RF transmission line structure 32 with coherent propagating parallel-plate electromagnetic plane waves 12 with a desired amplitude distribution which may or may not be uniform.

As a particular example, the RF device 30 may represent a parallel-plate array antenna or feed element. One or both of the boundary walls 32A, 32B may include an array of slots (not shown) or the like designed to extract and radiate RF energy provided from the electromagnetic waves 12. Use of such slots or other type apertures is well known in the art and therefore further description will be omitted for sake of brevity.

The feed structure 36 includes an arrangement of traveling-waveguide-fed leaky line-segment structures 38, in this embodiment leaky line-segment structures 38A, 38B. As is described in more detail below, each of the leaky line-segment structures 38 is configured to launch RF energy into the area 37 with a propagation direction having an oblique angle θ relative to an axis 16 of the line-segment structure 38. The leaky line-segment structures 38 can be any type of transmission line which is leaky in the sense that RF energy is continuously coupled (or "leaked") from the line-segment structure such that a desired amplitude distribution is realized ideally with a minimum amount of power remaining at the perimeter of the RF transmission line structure 32. In the exemplary embodiment, the leaky line-segment structures 38 are conventional end-fire oriented rectangular waveguides. However, other type line-segment structures are also suitable, such as homogeneously or inhomogeneously filled rectangular waveguides, single- or doubly-ridged waveguide, post-wall waveguide, suspended air stripline, etc.

Most preferably, the leaky line-segment structures 38 are configured to launch the RF energy into the area 37 as coherent propagating parallel-plate plane waves 12. In the embodiment of FIGS. 4A-4C, two leaky line-segment structures 38A,38B launch coherent parallel-plate waves at a designed oblique angle θ relative to their corresponding feed axis 16. The oblique orientation of these line-segment structures 38A, 38B serve to more efficiently conform to the circular form-factor of the parallel-plate region and therefore illuminate a larger percentage of the available area 37. Further, the RF phenomenology of the employed "end-fire" oriented line-segment structures 38A, 38B exhibits unusually stable beam position (the angle at which the RF waves launch relative to the axis of the feed) and therefore exemplary operating frequency bandwidth.

Continuing to refer to the embodiment of FIGS. 4A-4C, the leaky line-segment structures 38 are rear-mounted on the boundary wall 32B. Each of the line-segment structures 38 includes a continuous tapered or meandering (varying offset) slot 40 in its upper waveguide broadwall. The slot 40 extends through the boundary wall 32B thus enabling RF energy which leaks from the line-segment structures 38 to launch into the area 37 within the RF transmission line structure 32. The slot 40 is centered near the location of the upper feed 42 of the waveguide (for minimum coupling) and increases in offset monotonically relative to the centered axis 16 (increasing coupling) towards its lower extreme. An absorptive load (not shown) may be placed at the end of the waveguide 38A, 38B in order to absorb a small amount of uncoupled RF energy. When using the RF device 30 as a transmitting antenna, for example, RF energy is introduced into each of the waveguides 38A, 38B through its respective feed terminal 42 using conventional waveguide feed techniques. The RF energy then propagates through the respective waveguide 38A, 38B toward the end of the waveguide. During such time, the RF energy from each waveguide 38A, 38B is continuously coupled (or "leaked") from the line-segment structure 38 through the slot 40 such that a desired amplitude distribution at the desired oblique angle θ is realized within the transmission line structure 32.

As in the other embodiments described herein, the leaky line-segment structures 38 may be positioned proximate a perimeter of the non-rectilinear form factor of the RF transmission line structure 32. By selecting an appropriate oblique angle θ for each of the line-segment structures 38, the feed 36 is better able to illuminate efficiently the RF transmission line structure 32 with coherently propagating RF energy across the entire non-rectilinear form factor. The non-rectilinear form factor may be circular, elliptical, etc. The leaky line-segment structures 38 may be positioned along corresponding chords of the circular or elliptical form factor as exemplified in FIGS. 4A-4C. Moreover, the leaky line-segment structures 38 may be oriented at oblique angles to one another as exemplified in FIGS. 4A-4C. For example, two leaky line-segment structures 38 may be oriented at an oblique angle to one another and extend from a common vertex 46.

Those having ordinary skill in the art will appreciate that in an alternative embodiment the slot 40 may instead (or also) include an array of discrete broadwall slots or apertures, an array of discrete sidewall slots or apertures, etc. The leaky-line segment structures 38 need only be oriented properly relative to the RF transmission line structure 32 so that the RF energy may be launched appropriately into the area 37.

Figure 5:
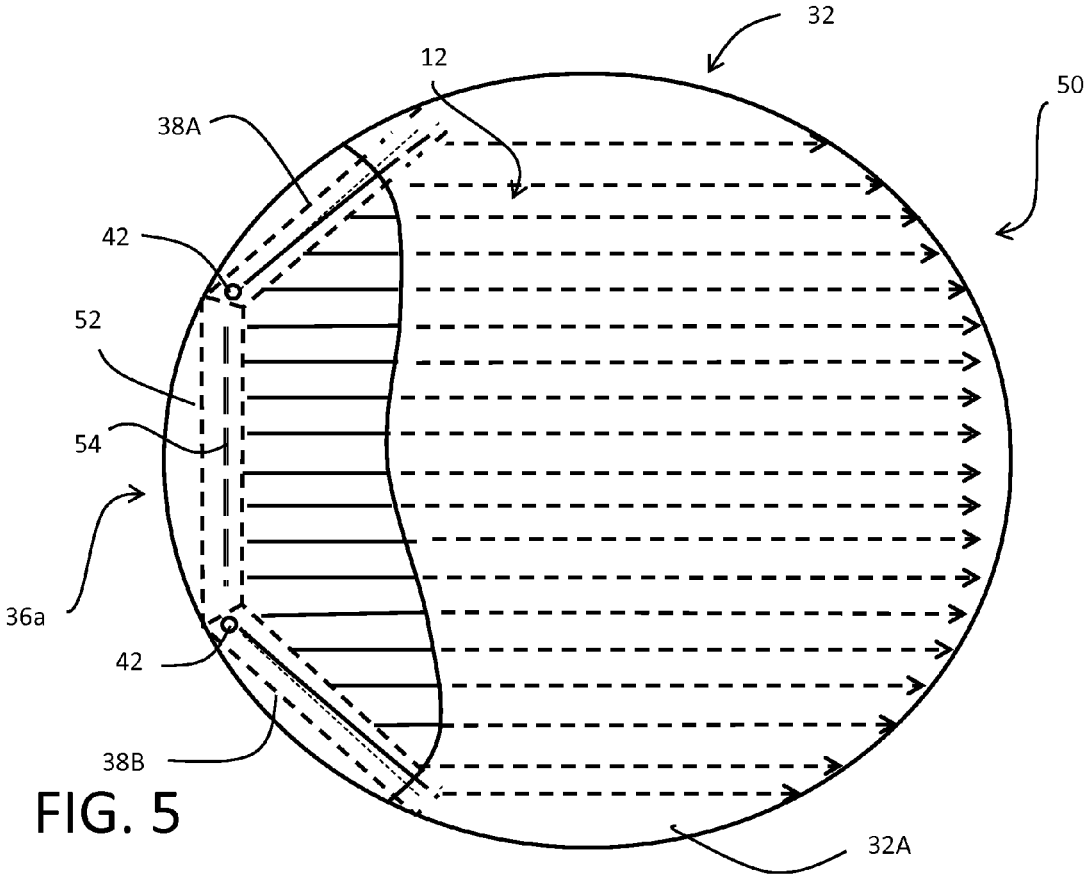
FIG. 5 is a top-view schematic illustration in partial cutaway of a second exemplary embodiment of an RF device having a feed structure in accordance with the present invention.

Referring now to FIG. 5, shown is another exemplary embodiment of an RF device denoted as 50. This embodiment varies from the embodiment in FIGS. 4A-4C in that the feed 36*a* further includes a feed segment 52 which separates the leaky line-segment structures 38A, 38B and is configured to launch the RF energy into the area 37 with a propagation direction having a non-oblique angle relative to an axis of the feed segment 52. As shown in FIG. 5, the feed segment 52 again is a rectangular waveguide which includes one or more slots 54 in its broadwall which extend through the boundary wall 32B thus enabling RF energy to leak from the feed segment 52 to launch into the area 37. Similar to the waveguide line-feeds 10 in conventional devices, the feed segment 52 is configured to launch the parallel-plate waves in a direction normal to its axis. Combined with the leaky line-segment structures 38A, 38B located adjacent to the line feed segment 52 yet configured to launch the RF energy into the area 37 with a propagation direction having an oblique angle θ, the area efficiency of the non-rectilinear form factor is improved as compared with the embodiment of FIGS. 4A-4C. Furthermore, the operating frequency bandwidth of the device 50 is improved (based of the resultant smaller physical length of the leaky line-segment structures 38A, 38B and greater flexibility in selection of the oblique angle θ.)

According to a variation of the embodiment in FIG. 5, the feed segment 52 is composed of n (e.g., 20) waveguide coupling elements fed via a (n+2)-way (e.g., 22-way) waveguide corporate feed structure. The outermost ports of the waveguide feed segment 52 (the 1st and (n+2)th ports) serve to feed the inclined leaky line-segment structures 38A, 38B via the individual waveguide feeds 42.

Those having ordinary skill in the art will appreciate that any number of leaky line-segment structures 38 along with any number of traditional line-feeds 50 may be combined in a device. The line-segment structures 38 and line-feeds 50 may be distributed, preferably about a perimeter of the non-rectilinear form factor in order to most efficiently illuminate the area within the boundary walls 32. Moreover, each leaky line-segment structure 38 may be designed for its own particular oblique angle θ. Namely, the value of the oblique angle θ is selected based on the particular orientation of the line-segment structure 38 relative to the other line-segment structures and the desired direction of the coherent parallel-plate waves.

Figure 6:
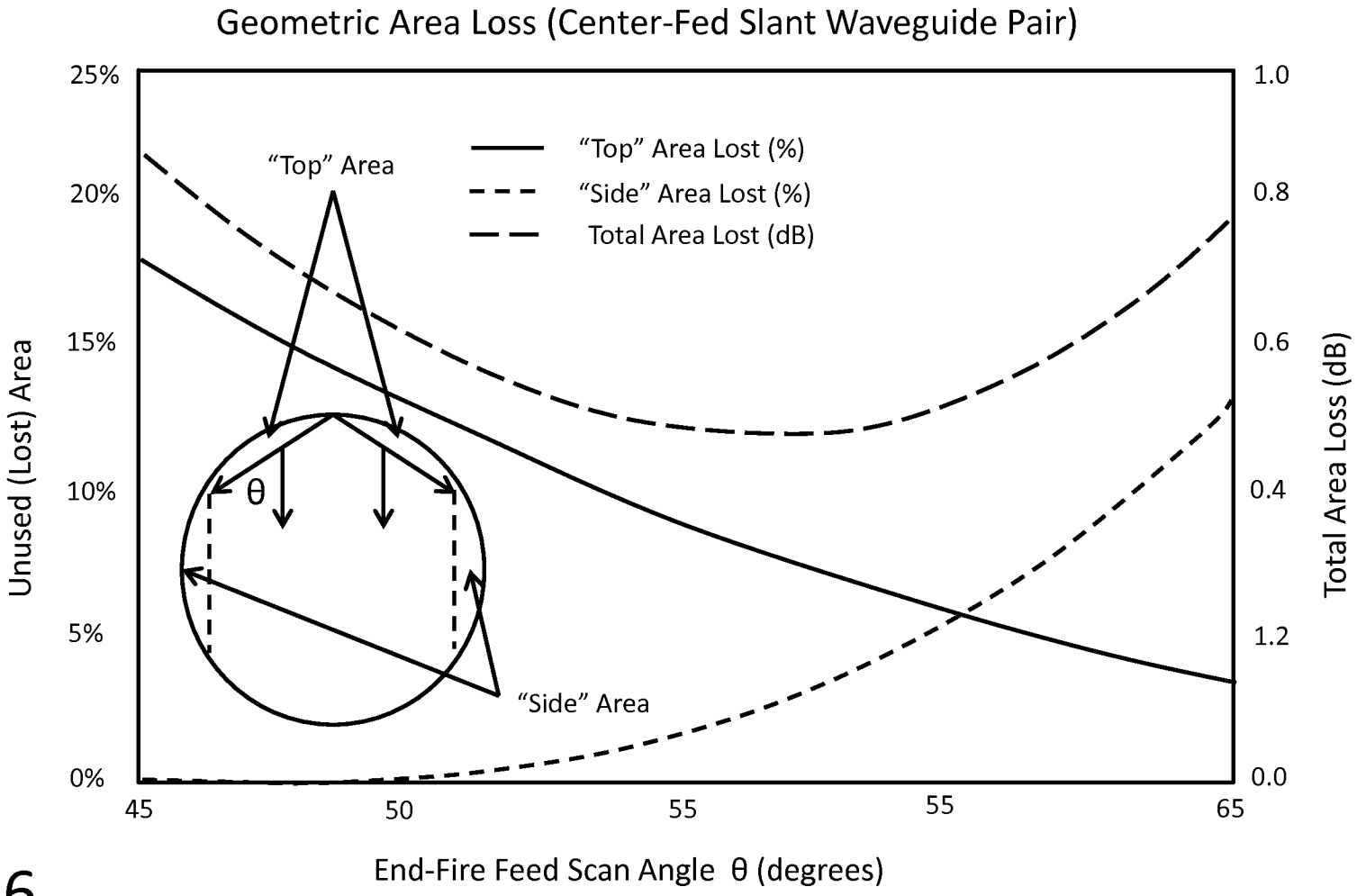
FIG. 6 is a graph showing the theoretical area efficiency of an RF device in accordance with the embodiment of FIGS. 4A-4C.

Regarding the area efficiency metrics for the embodiment of FIGS. 4A-4C as a function of oblique angle θ, FIG. 6 illustrates that theoretically the area efficiency is maximized (at a value of 88%) for angles θ between 55 and 60 degrees. For the embodiment of FIG. 5, it can be shown that this theoretical area efficiency increases to approximately 92% and at a smaller angle θ of approximately 45 degrees.

Figure 7:
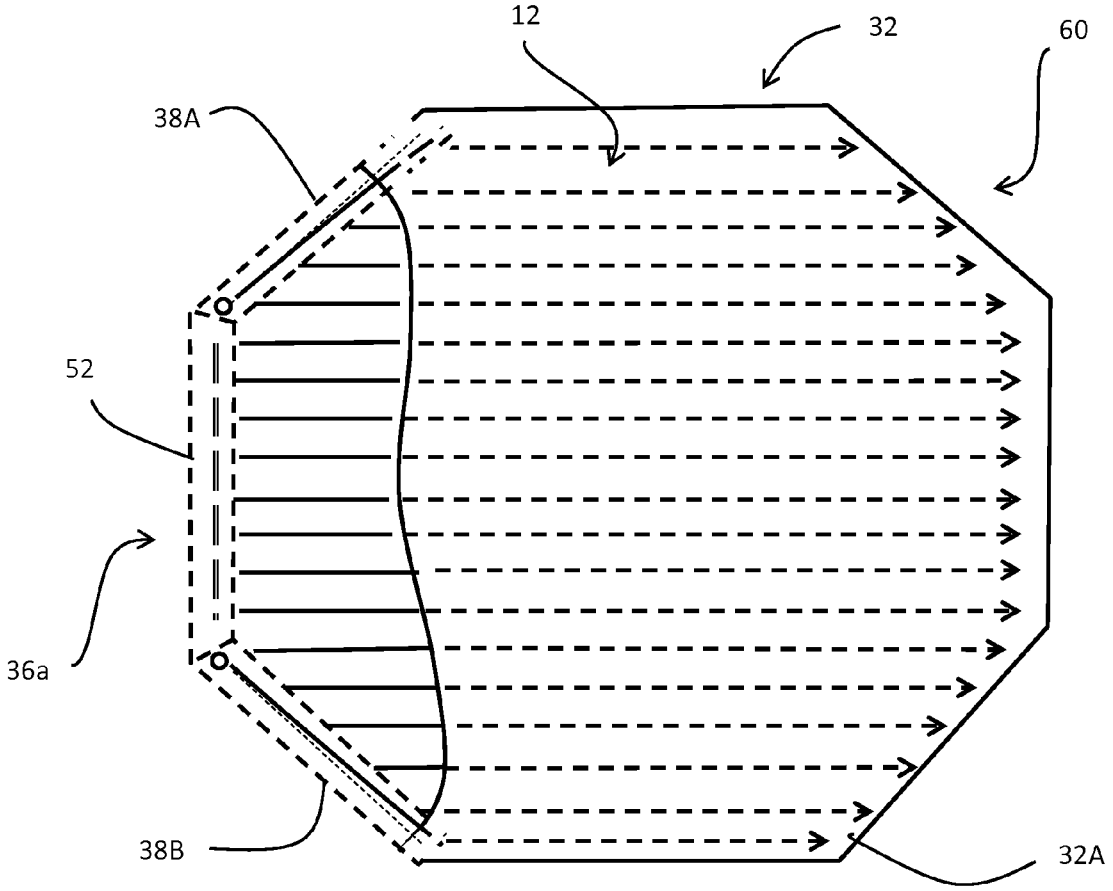
FIG. 7 is a top-view schematic illustration in partial cutaway of a third exemplary embodiment of an RF device having a feed structure in accordance with the present invention.

Referring briefly to FIG. 7, another embodiment of an RF device is denoted as 60. The embodiment is essentially identical to that of the embodiment in FIG. 5; however, the RF device 60 in this case includes an RF transmission line structure 32 which has a non-rectilinear form factor different from a circle. In this embodiment, the RF transmission line structure 32 is an octagon although it will be appreciated that virtually any other non-rectilinear form factor is equally possible.

Figure 8:
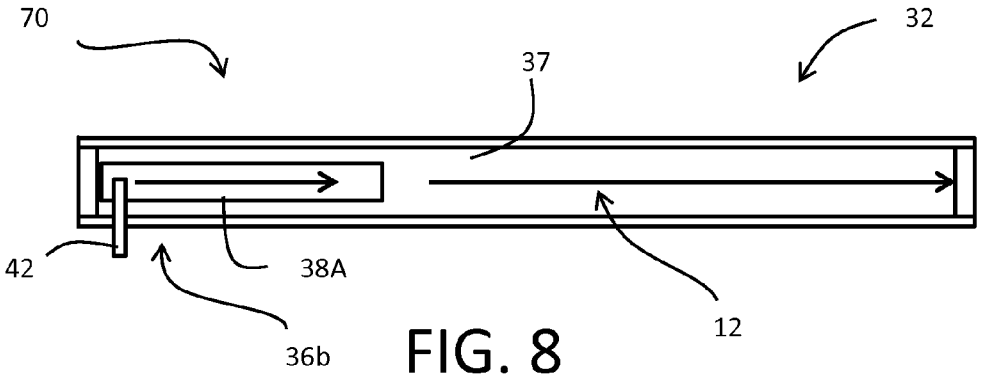
FIG. 8 is schematic cross-sectional illustration of a fourth exemplary embodiment of an RF device in accordance with the present invention.

FIG. 8 illustrates another embodiment of an RF device denoted as 70. The embodiment is the same as the embodiment in FIGS. 4A-4C with the following exceptions. In this embodiment, the leaky line-segment structures 38 are positioned between the opposing boundary walls 32A, 32B rather than being rear-mounted (i.e., adjacent an outer surface of one or both of the opposing boundary walls). The leaky line-segment structures 38 again are configured with at least one of a continuous broadwall coupling slot, an array of discrete broadwall slots or apertures, or an array of discrete sidewall slots or apertures, so that the RF energy introduced via the feeds 42 may leak from the line-segment structures 38 to launch into the area 37 within the RF transmission line structure 32 at a desired oblique angle θ. According to yet another embodiment, the leaky line-segment structures 38 may be located adjacent an opening between the opposing boundary walls 32A, 32B along the perimeter of the non-rectilinear form factor. In other words, the leaky line-segment structures 38 need not be located directly in between the opposing boundary walls 32A, 32B.

Figure 9:
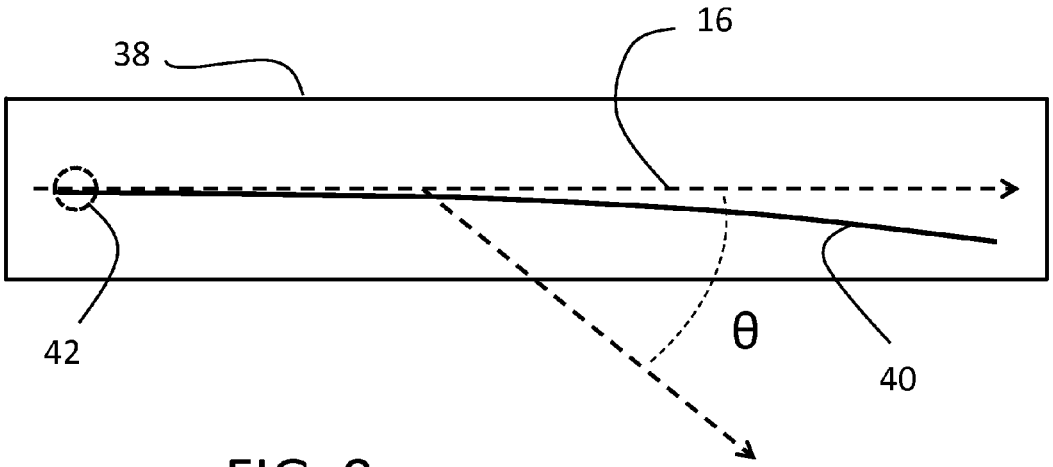
FIG. 9 is a top view schematic illustration of a leaky line-segment structure according to an exemplary embodiment.

FIG. 9 is a top view schematic illustration of a leaky line-segment structure 38 according to an exemplary embodiment and is shown in larger detail. The line-segment structure 38 is realized as a rectangular waveguide section with a continuous tapered (varying offset) slot 40 in its upper waveguide broadwall. The central linear axis of the waveguide section is represented by axis 16. The slot 40 is centered along the axis 16 near the feed 42 location (minimum coupling), and increases in offset monotonically from the axis 16 (increasing coupling) towards its opposite end (where an absorptive load, not shown, is typically placed in order to absorb a small amount of uncoupled RF energy).

Figure 11:
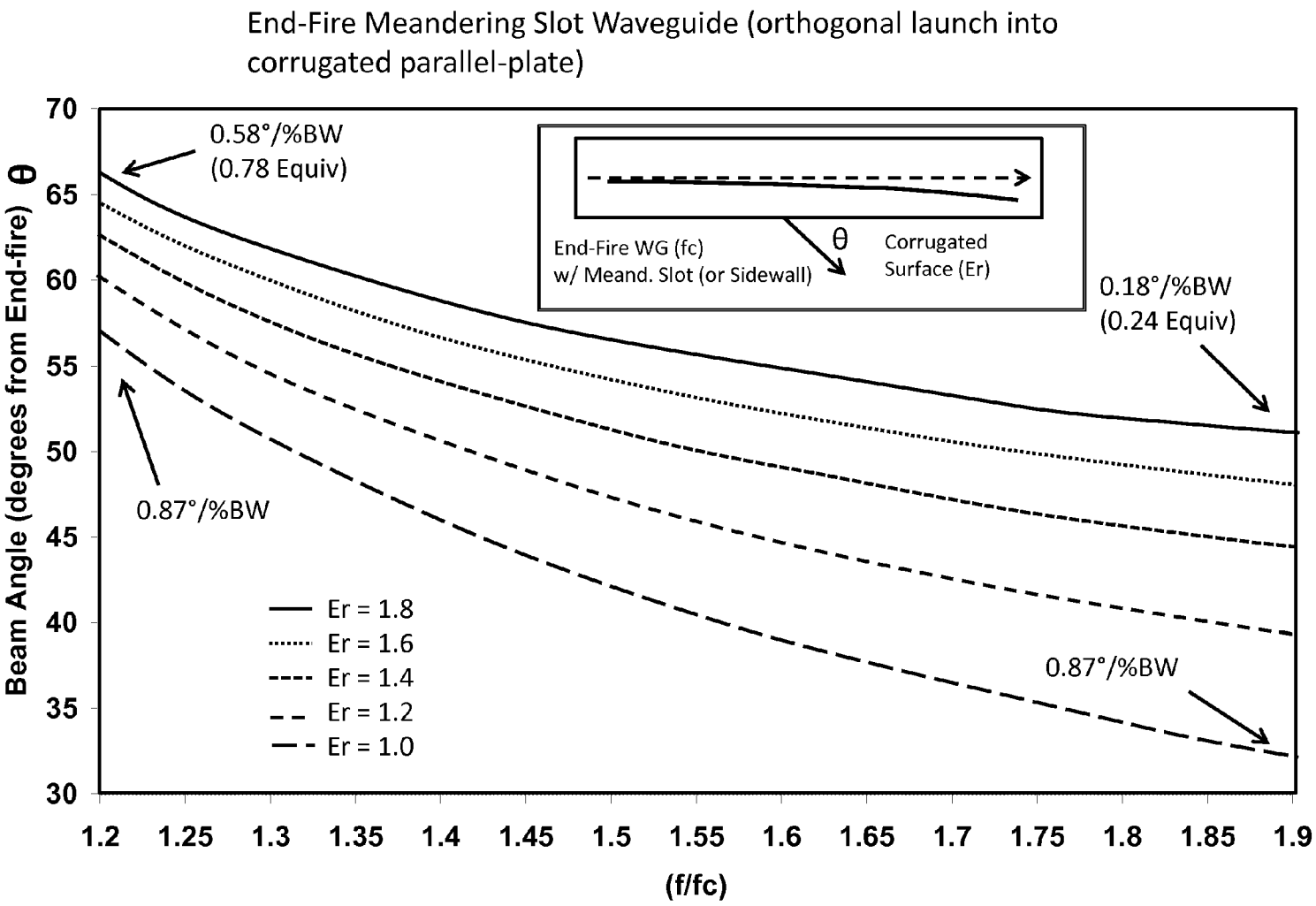
FIG. 11 is a graph illustrating the computed beam angle (8) for An exemplary leaky line segment structure as a function of frequency.

The desired amplitude distribution along the length of the leaky line-segment structure is generally driven by a number of factors including compensation for the varying lengths of the propagation paths 12, desired tapering of the amplitude towards the edges of the array in order to reduce antenna pattern sidelobes, and conservation of RF energy along the leaking RF paths such that sufficient energy is available at the end/terminus of the leaky-wave path. The amount of coupling (amount of RF energy leaked per unit length along the feed path) is regulated primarily by the relative mechanical offset of the coupling slot 40 relative to the center-line of the feed 16 (increasing offset producing increasing coupling). Other factors including the selected width and thickness of the slot, the physical internal height and width (characteristic impedance) of the leaky line-segment and the height and physical details of the parallel-plate (characteristic impedance and effective dielectric constant) also play a in determining the leaky-wave coupling (leakage per unit length) factor. Similarly, the oblique angle of the energy emanating from the leaky line-segment is determined primarily by the internal width (cut-off frequency, fc, as shown in FIG. 11) for the leaky line-segment structure and the effective dielectric constant (Er as shown in FIG. 11) of the parallel-plate structure (generally dictated by the specific geometry of any physical corrugations or dielectric material properties employed in the parallel-plate region) though the other aforementioned design details also can have second-order effects on the specific oblique angle. Based on the disclosure herein, one having ordinary skill in the art will readily appreciate the application of these principles in order to arrive at the specifically desired oblique angle θ.

Figure 10:
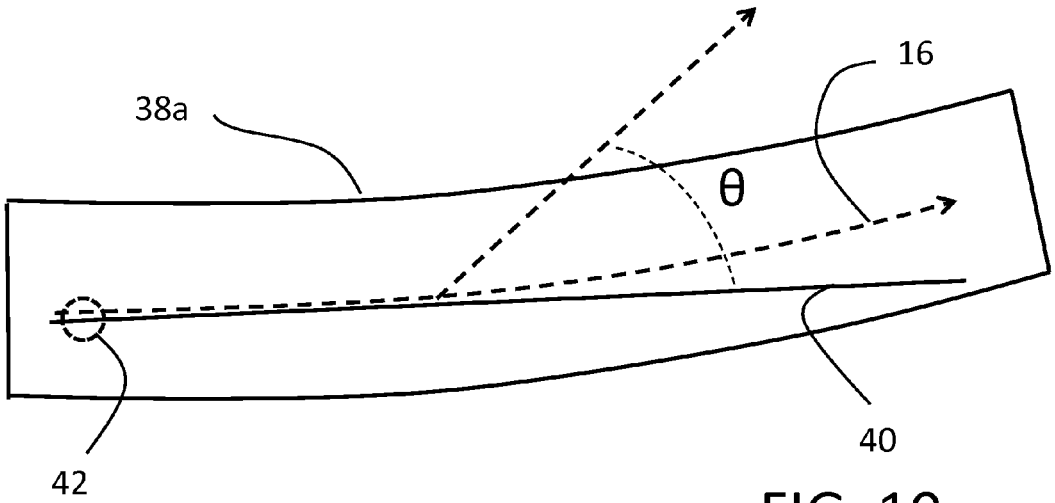
FIG. 10 is a top view schematic illustration of a leaky line-segment structure according to an alternative exemplary embodiment.

FIG. 10 illustrates another embodiment of a leaky line-segment structure 38, in this case denoted 38*a*. Again the line-segment structure 38 is made up of a rectangular waveguide section, but in this case with the slot 40 being linear (straight) and the waveguide itself "curving" in order to realize the desired variable slot offset. The slot 40 preferably is formed in the broadwall of the waveguide, with the waveguide curving in a plane perpendicular to the broadwall. In this case, the linear slot 40 itself represents the axis of the line-segment structure 38*a* and the axis 16 instead represents the axis of curvature of the waveguide.

In other words, when the embodiment of FIG. 10 is employed, the oblique angle θ may be defined by the axis, or main line of direction of the line-segment structure, represented by the (straight) slot 40. In the case of the curved slot 40 in the embodiment of FIG. 9, the oblique angle θ may be defined relative to the straight axis 16, again representing the main line of direction of the waveguide.

With respect to the embodiment of FIG. 9, it may be desirable to employ a slight variation in the "a" (broadwall) dimension along the length of the waveguide. This varies the propagation constant within the waveguide and thus is useful in order to compensate for non-linear phase "error" which may be introduced by the curved slot geometry. More specifically, the variation in the "a" dimension may be selected so as to vary the propagation constant such that the cumulative phase (integrated propagation constant along the length of the waveguide) conjugates (cancels the phase error) introduced by the curved slot. Conversely, when employing the curved waveguide as in the embodiment of FIG. 10 the "a" dimension may be constant (for a constant propagation constant).

As will be appreciated, in either of the embodiments of FIGS. 9 and 10, the linear continuous slot 40 can equally be adapted or replaced with a linear array of discrete broadwall slots or apertures, a linear array of discrete sidewall slots or apertures, or some combination thereof.

FIG. 11 shows the computed oblique angle θ (degrees from end-fire) for a leaky line-segment structure 38 as a function of frequency (the quotient f/fc, the frequency divided by the cutoff frequency for the waveguide) and for various effective dielectric constants within the parallel-plate region area 37. Also shown on this graph is the computed beamwalk (beam stability) expressed as the expected angle change (in degrees) per percent of operating frequency change. Optimal bandwidth performance (minimum beamwalk, e.g. minimum variation in launch angle as frequency is varied) is achieved at the highest (f/fc) values and for the highest effective dielectric constant (0.18 degrees/percent bandwidth for Er=1.8 and (f/fc)=1.9) This beam stability value is approximately 4× better (75% smaller) than the beamwalk expected in a typical line-feed as employed in the above-described conventional inscribed-square design.

Figure 12:
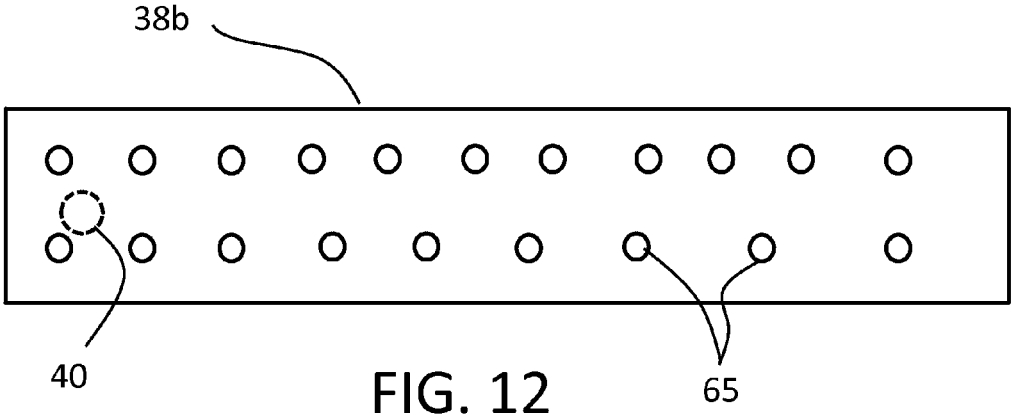
FIG. 12 is a top view schematic illustration of a leaky line-segment structure according to another alternative exemplary embodiment.

FIG. 12 illustrates another example of a leaky line-segment, in this instance one formed by a post-wall waveguide 38*b*. The spacings between the posts 65 along one of the walls are varied in order that the RF energy introduced via the feed 42 may leak from the line-segment structure 38*a* at the desired oblique angle θ.

As described herein, the RF device 30 utilizes a combination of features in order to efficiently feed an RF transmission line structure including opposing boundary walls with a non-rectilinear form factor. The opposing boundary walls preferably are parallel or semi-parallel plates to form parallel/semi-parallel plate regions. The RF device can be any parallel/semi-parallel plate RF structure, but is particularly well suited for circularly-shaped Continuous Transverse Stub (CTS) arrays and Variable Inclination Continuous Transverse Stub arrays.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

The invention claimed is:

1. A radio frequency (RF) device, comprising:

an RF transmission line structure including opposing boundary walls, the RF transmission line structure having a non-rectilinear form factor; and a feed structure configured to introduce RF energy into an area between the opposing boundary walls to excite the RF transmission line structure with the RF energy across the non-rectilinear form factor, the feed structure including:

a plurality of traveling-waveguide-fed leaky line-segment structures, each having a longitudinal axis, the plurality of traveling-waveguide-fed leaky line segment structures configured to introduce the RF energy into the area with a propagation direction having an oblique angle relative to the longitudinal axis of the line-segment structure.

2. The RF device according to claim 1, wherein the plurality of leaky line-segment structures are positioned proximate a perimeter of the non-rectilinear form factor.

3. The RF device according to claim 1, wherein the non-rectilinear form factor is circular or elliptical.

4. The RF device according to claim 3, wherein the plurality of leaky line-segment structures are positioned along corresponding chords of the circular or elliptical form factor.

5. The RF device according to claim 1, wherein two or more of the plurality of leaky line-segment structures are oriented at oblique angles to one another.

6. The RF device according to claim 5, wherein two of the plurality of leaky line-segment structures are oriented at an oblique angle to one another and extend from a common vertex.

7. The RF device according to claim 5, wherein two of the plurality of leaky line-segment structures are oriented at an oblique angle to one another and the feed structure further includes one or more feed segments which separate the two plurality of leaky line-segment structures and are configured to introduce the RF energy into the area with a propagation direction having a non-oblique angle relative to an axis of the feed segment.

8. The RF device according to claim 1, wherein one or more of the plurality of leaky line-segment structures is an end-fire leaky waveguide.

9. The RF device according to claim 8, wherein the end-fire leaky waveguide includes at least one of a continuous broadwall coupling slot, an array of discrete broadwall slots or apertures, or an array of discrete sidewall slots or apertures.

10. The RF device according to claim 9, wherein the end-fire leaky waveguide includes a meandering slot.

11. The RF device according to claim 10, wherein the end-fire leaky waveguide has a variation in the "a" (broadwall) dimension along a length of the end-fire leaky waveguide.

12. The RF device according to claim 1, wherein the plurality of leaky line-segment structures are positioned at least one of between the opposing boundary walls, adjacent an outer surface of one or both of the opposing boundary walls, or adjacent an opening between the opposing boundary walls along a perimeter of the non-rectilinear form factor.

13. The RF device according to claim 1, wherein the RF transmission line structure comprises at least one of a parallel-plate transmission structure, a partially open transmission structure having a lower-plate covered in a dielectric layer, a waveguide, or a resonant cavity.

14. The RF device according to claim 1, wherein the plurality of leaky line-segment structures are configured to introduce the RF energy in coherent waves.

15. The RF device according to claim 1, wherein at least one of the plurality of leaky line-segment structures comprises a curved waveguide including at least one of a linear continuous broadwall coupling slot, a linear array of discrete broadwall slots or apertures, or a linear array of discrete sidewall slots or apertures.

16. The RF device according to claim 15, wherein the curved waveguide has a constant "a" (broadwall) dimension.

* * * * *